United States Patent [19]

Kokubo et al.

[11] 4,268,024

[45] May 19, 1981

[54] BANK NOTE HOLDING METHOD FOR BANK NOTE COUNTING MACHINE

[75] Inventors: Eiichi Kokubo; Tuyoshi Miyagawa, both of Tokyo, Japan

[73] Assignee: Laurel Bank Machine Co., Ltd., Tokyo, Japan

[21] Appl. No.: 37,011

[22] Filed: May 8, 1979

[30] Foreign Application Priority Data

May 11, 1978 [JP] Japan ..... 53/55964

[51] Int. Cl.[3] ..... B65H 3/42

[52] U.S. Cl. ..... 271/95; 271/149; 271/162

[58] Field of Search ..... 271/95, 149, 160, 162; 235/925 B; 414/114, 115, 330

[56] References Cited

U.S. PATENT DOCUMENTS 3,652,081 3/1972 Hatanaka et al. ..... 271/95
3,983,367 9/1976 Kondo et al. ..... 235/925 B

FOREIGN PATENT DOCUMENTS 2328583 4/1976 Fed. Rep. of Germany .
47-5962 2/1972 Japan .
49-116767 11/1974 Japan .
1410125 10/1975 United Kingdom ..... 271/95

*Primary Examiner*—Robert W. Saifer
*Attorney, Agent, or Firm*—Fleit & Jacobson

[57] ABSTRACT

A bank note holding method for a counting machine which counts bank notes or the like. These bank notes are placed upon a holder and are clamped with a keep rod. The bank notes thus placed and clamped are forced into abutment contact with a plurality of suction cylinders, which are made operable to make planetary movements, so that they may be sucked and separated one by one by the suction cylinders, thus accomplishing counting operation. For this purpose, the bank notes are arranged uniformly on the holder, and then the keep rod is moved toward the holder by depressing a push button so that the bank notes may be forced into contact with and held upon the holder. The push button is then released so that the holder may be moved to its counting position thereby to start the counting operation. After this operation, the holder and the keep rod are returned to their respective initial positions.

2 Claims, 4 Drawing Figures

BANK NOTE HOLDING METHOD FOR BANK NOTE COUNTING MACHINE

BACKGROUND OF THE INVENTION

1. Field of the Invention

The present invention relates to a bank note holding method for a counting machine for counting bank notes or the like (which will be referred to briefly as "bank notes" ) and contemplates to facilitate the operations and improve the counting accuracy by charging a holder with bank notes in a uniformly arranged condition and by moving the holder to its counting position while maintaining the arranged condition.

2. Description of the Prior Art

In a counting machine of such type, generally speaking, the temporary holding operation of the bank notes is automatically performed in response to the charging operation of a holder with the bank notes by means of a temporary holding mechanism which is provided separately of a bank note holding member. In this counting machine, the bank notes are usually arranged into a uniform stack before they are placed upon the holder. Especially, used bank notes having no seal bank will become irregular, when they are fed to the holder, so that the temporary holding operation may frequently be accomplished under the resultant irregular condition. As a result, the old bank notes fail to be sucked one by one in a reliable manner, when they are placed upon the holder and are to be counted, so that an error takes place in the counting operation.

In addition to this disadvantage, the temporary holding operation of the bank notes has to resort to such temporary holding mechanism, and then the bank notes are moved to their counting position so that the stability of the bank notes may be ensured by the coaction of the keep rod and the holder. This results in another disadvantage that the counting machine has to be equipped with a complicated mechanism.

SUMMARY OF THE INVENTION

It is therefore a major object of the present invention to provide a bank note holding method for a bank note counting machine, which is free from any drawback of the prior art.

According to a major aspect of the present invention, there is provided a bank note holding method for a bank note counting machine, in which bank notes or the like placed upon a holder and clamped with a keep rod are forced into abutment contact with a plurality of suction cylinders made operable to make planetary movements so that they may be sucked and deflected one by one by said suction cylinders thereby to be counted, comprising the steps of: bringing said keep rod at the beginning of the counting operation toward the holder, which is positioned at the charging side of the bank notes, until it abuts against the bank notes; and returning said holder and said keep rod to their respective initial positions at the end of the counting operation.

BRIEF DESCRIPTION OF THE DRAWINGS

Other objects and advantages of the present invention will become apparent from the following description taken in conjunction with the accompanying drawings.

DESCRIPTION OF THE PREFERRED EMBODIMENT

Figure 1:
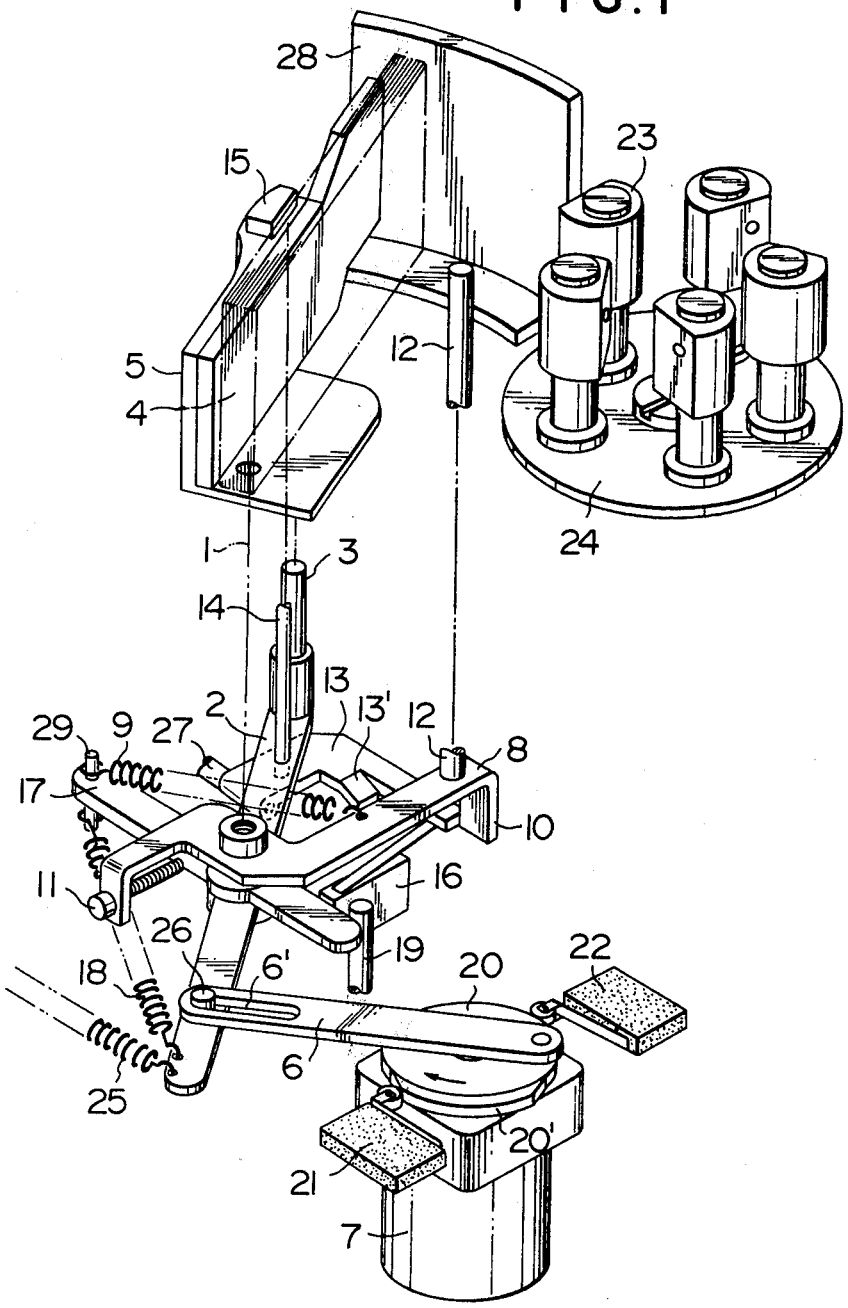
FIG. 1 is a perspective view showing a bank note holding mechanism exemplifying the bank note holding method according to the present invention.

The present invention will now be described in detail in connection with one embodiment thereof with reference to the accompanying drawings in the case of counting bank notes.

There is mounted to a shaft 1 a rotatable holder support plate 2, to one end of which a holder 5 stably chargeable with bank notes 4 is mounted by means of a support shaft 3 so that it can rotate about the shaft 1 together with the holder support plate 2. There is anchored at the other end of the support plate 2 a pin 26 which is fitted in a slot 6' formed in one end of an actuating lever 6. There are also attached under tension to the other end of the support plate 2 both a clamp spring 18 having a high righting force for clamping the bank notes 4 and a paper feed spring 25 having a low righting force for bringing the bank notes 4 into abutment engagement with suction cylinders 23 carried on a rotary disc 24 when the holder 5 is moved to its counting position. The actuating lever 6 has its other end supported rotatably on a pin which is anchored at the periphery of such a cam 20 as is turned by an electric motor 7. On the other hand, the cam 20 has its side formed with a projecting portion 20' for operating microswitches 21 and 22.

There is also mounted to the shaft 1 an actuating plate 8 which is biased by means of a temporary holding spring 9 having a low righting force and which has its leading end formed with a pawl 10 and its other end equipped with an adjusting screw 11. Moreover, a keep rod 12 is mounted to the leading end of the actuating plate 8. The adjusting screw 11 has its leading end located at such a position as can push the side of a spring holding plate 17, which is also mounted rotatably to the shaft 1, when the holder 5 is moved to its counting position.

A stopper plate 13 made engageable with the pawl 10 is mounted to a shaft 27 in a manner to rotate in vertical directions and is biased upward by means of a spring, not shown, to such an extent as to abut against lower end of a push lever 14. This push lever 14 is connected to a push button 15 which is mounted on the aforementioned holder 5. The stopper plate 13 thus constructed is made coactive with a switch 16.

The aforementioned clamp spring 18 and the temporary holding spring 9 are held by means of a pin 29 at the one end of the spring holding plate 17 which is mounted rotatably to the shaft 1. There is arranged at the other end of the spring holding plate 17 a stopper 19 which is made operative to limit the counterclockwise rotations of the plate 17.

Figure 2:
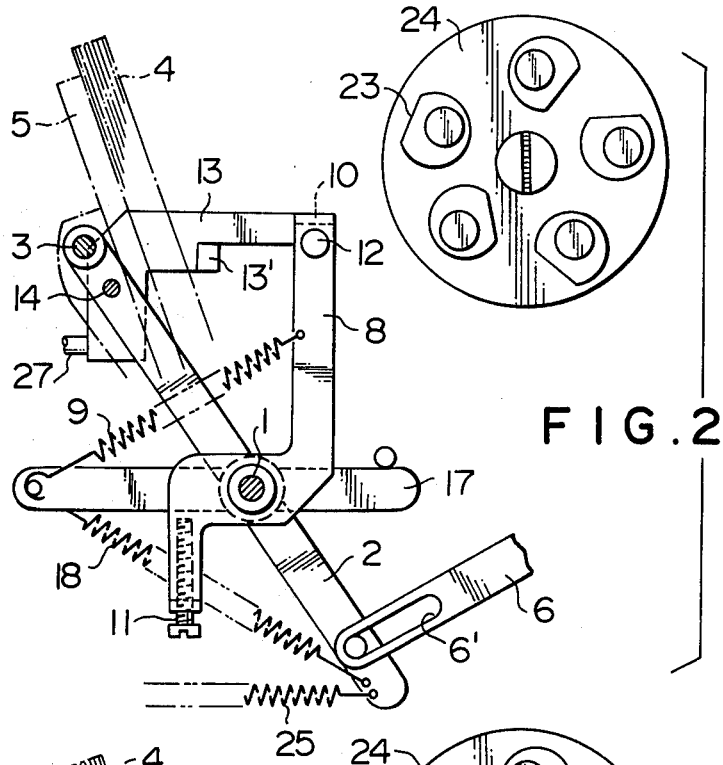
FIGS. 2 to 4 are top plan views showing the operations of the bank note holding mechanism of FIG. 1 in the order thereof.
Figure 3:
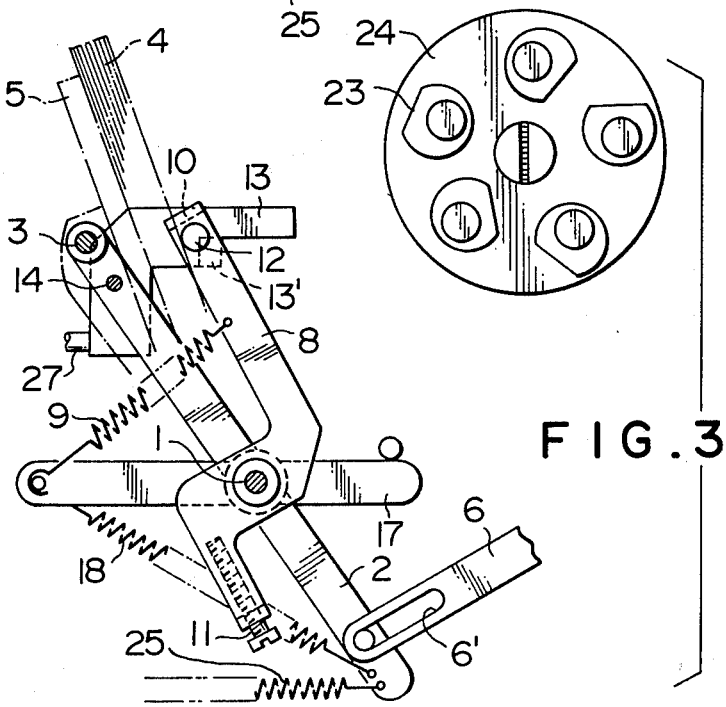

As better seen from FIG. 2, when the holder 5 is in its charging position of the bank notes 4, it is charged with a bundle of the bank notes 4 such that these bank notes 4 are brought into contact with the side and bottom of the holder 5 and that they are arranged uniformly by means of a paper arranging plate 28 (shown in FIG. 1). If the push button 15 is depressed after the uniform arrangement, the stopper plate 13 is moved down through the push lever 14 against the action of the spring (not shown). As a result, the pawl 10 is disengaged from the stopper plate 13, and the keep rod 12 fixed to the actuating plate 8 is turned about the shaft by the righting force of the temporary holding spring 9, as better seen from FIG. 3, so that the bundle of the bank notes 4 arranged are forced into contact with the side of the holder 5. Thus, the bank notes 4 can be held in their uniformly arranged condition.

The operating member of the switch 16 is depressed by the downward movement of the stopper plate 13 and then is released again in response to the release of the push button 15. At this time, the switch 16 generates a start signal to energize the electric motor 7 so that the cam 20 is turned by the motor 7. Then, the switch 21 is changed over by the projecting portion 20' of the cam 20, and the other switch 22 is turned off, when the cam 20 is turned about 180 degrees, so that the motor 7 is stopped. A detailed construction and operation of these electric elements can be found in the disclosure of Japanese Pat. No. 657640 of the same Application.

Figure 4:
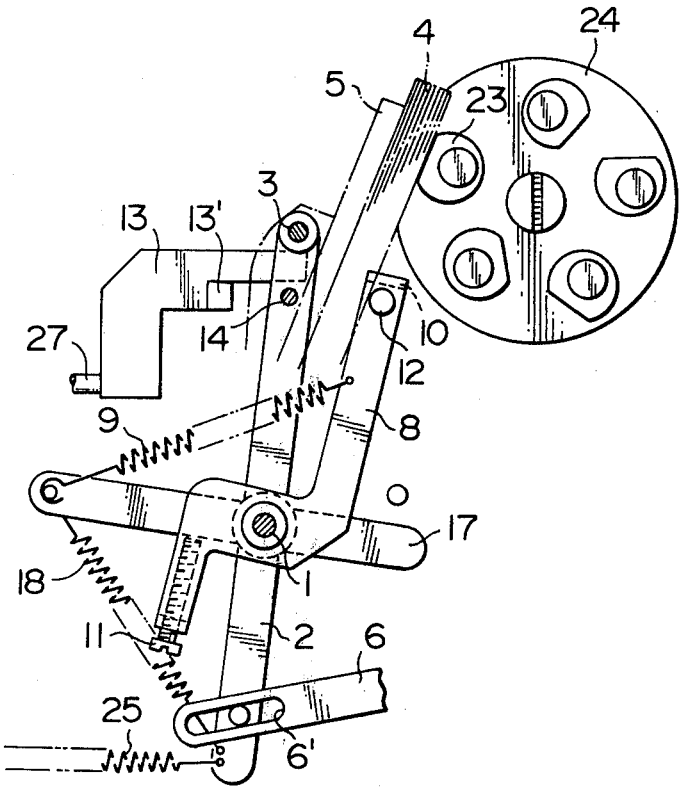

The rotation of the cam 20 by 180 degrees is transmitted through the actuating lever 6 to turn the holder support plate 2 about the shaft 1 so that all of the holder 5, the bank notes 4, the keep rod 12 and the actuating plate 8 are brought to the counting position of the bank notes 4. At this instant, the leading end of the adjusting screw 11 pushes the spring holding plate 17, as better seen from FIG. 4, so that the shaft 3 is turned clockwise about the shaft 1. In this instance, the clamp spring 18 has a limited righting force and acts only to loosely clamp the bank notes 4 upon the holder 5. When the bank notes 4 are brought into abutment contact with one of the suction cylinders 23 by the movement of the holder 5, a vacuum pump (not shown), which is energized by the start signal of the aforementioned switch 16, evacuates the insides of the suction cylinders 23 thereby to change over a vacuum switch (not shown). As a result, the suction cylinders 23 and the rotary disc 24 start their respective rotations so that the bank notes 4 are sucked and deflected one by one by the suction cylinders 23. In response to these deflecting operations, the paper feed spring 25 turns the holder 5, the bank notes 4 and the keep rod 12, which are integrated by the clamp spring 18, in the clockwise direction about the shaft 1. At the same time, the paper feed spring 25 always brings the exposed side of the bank notes 4 to be counted into abutment contact with the suction cylinders 23 so that the non-counted bank notes 4 may be put in a good condition to be deflected.

After the counting operation of the bank notes 4 is finished in the manner described in the above, the pressure in the suction cylinders 23 is increased to change over the vacuum switch (not shown) to its initial condition. As a result, the motor 7 is again turned 180 degrees in connection with the counting mechanism so that the holder 5 is returned to the position shown in FIG. 2. In accordance with the shift from the charging position to the counting position, meanwhile, the pawl 10 and the push lever 14 are disengaged from the stopper plate 13. In the returning course of the holder 5 to the charging position, therefore, the pawl 10 restores its engagement with the stopper plate 13 until it is stopped at a preset position on the way of its return so that the push lever 14 is returned to its initial position while being guided by the slope 13' formed at the leading end of the plate 13.

When the pawl 10 is stopped, the bank notes 4 are released from the forced engagement with the keep rod 12 by the temporary holding spring 9 so that they can be taken out of the holder 5.

As has been described hereinbefore, according to the present invention, the bank notes or the like are placed on the holder and sufficiently arranged thereon, and then the keep rod is moved toward the holder by depressing the push button so that the bank notes or the like may be forced into contact with and held upon the holder. After that, the push button is released so that the holder may be moved to its counting position thereby to start the counting operation. As a result, therefore, the charging operation of the holder with the arranged bank notes or the like can be performed easily and reliably. Moreover, the bank notes or the like can be prevented from becoming irregular upon the holder so that the counting operation can be accomplished without any error.

What is claimed is:

1. A bank note holding mechanism for use in a bank note counting machine having a frame, and a plurality of suction cylinders which make planetary movements so that bank notes are counted while being sucked and deflected one by one by the suction cylinders, the holding mechanism comprising:

a holder (5) for receiving bank notes to be counted;

a keep rod (12) for clamping the bank notes to the holder;

means for forcing clamped bank notes into contact with the suction cylinders;

a shaft (1) mounted on a frame of the machine;

a holder support plate (2) for supporting the holder (5), the holder and support plate being pivotably mounted on the shaft (1);

a motor (7) for rotating said support plate about for shaft (1);

means for interconnecting said motor and said support plate;

an actuating plate (8) having the keep rod (12), said actuating plate being pivotably mounted on the shaft (1);

a first spring (9) connected at one end to the actuating plate (8) for biasing the same away from the suction cylinders (23);

a spring holding plate (17) pivotably mounted on the shaft (1) and connected to the other end of the first spring (9); and a second spring (18) connected at the opposite ends thereof to the holder support plate (2) and the spring holding plate (17) for rigidly holding the bank notes between the holder (5) and the keep rod (12).

2. A bank note holding mechanism as set forth in claim 1, further including a stopper plate (13) for holding said holder support plate (2) in an initial position wherein said keep rod (12) is spaced from said holder (5), and a manually operable push button (15) for disengaging said holder support plate (2) from said stopper plate (13) and thereby bringing the same toward the holder (5).

* * * * *